US005140762A

United States Patent [19]

Monson

[11] Patent Number: 5,140,762

[45] Date of Patent: Aug. 25, 1992

[54] APPARATUS FOR MELTING SNOW AND ICE

[75] Inventor: Wilbur G. Monson, Springfield, Oreg.

[73] Assignee: Mikkal Oare, Eugene, Oreg.

[21] Appl. No.: 653,957

[22] Filed: Feb. 12, 1991

[51] Int. Cl.[5] ..... E01H 5/10

[52] U.S. Cl. ..... 37/230; 37/227

[58] Field of Search ..... 37/227, 228, 229, 230

[56] References Cited

U.S. PATENT DOCUMENTS

| | | | |
|---|---|---|---|
| 1,179,809 | 4/1916 | Dabelstein | 37/230 |
| 2,364,315 | 12/1944 | Powell | 37/227 X |
| 2,820,450 | 1/1958 | Zimmerman | 37/230 X |
| 3,189,021 | 3/1963 | Giguere . | |
| 3,471,681 | 10/1969 | Miller . | |
| 3,559,337 | 2/1971 | Marcoux et al. . | |
| 3,745,700 | 7/1973 | Hahn | 37/227 X |
| 3,964,183 | 6/1976 | Movat | 37/227 X |
| 4,033,055 | 7/1977 | Lazarecky | 37/230 |
| 4,409,957 | 10/1983 | Muhammad | 37/227 X |

*Primary Examiner*—Randolph A. Reese
*Assistant Examiner*—J. Russell McBee
*Attorney, Agent, or Firm*—Fleit, Jacobson, Cohn, Price, Holman & Stern

[57] ABSTRACT

Apparatus for melting snow and ice includes hand-propelled wheeled frame on which is mounted a motor and generator and a heater positioned substantially parallel to and spaced from the ground to be cleared of snow. The snow melting apparatus is propelled by a user walking behind the apparatus. The heater includes heating elements which are covered by plates for reflecting heat downward as the snow melting apparatus is moved across snow-covered ground, clearing the area passed over by the apparatus. The heater may include two or more heating units. A forward heating unit may be hinged to a rearward heating unit to allow the forward unit to be raised for ease of moving the apparatus and for storage.

3 Claims, 1 Drawing Sheet

APPARATUS FOR MELTING SNOW AND ICE

FIELD OF THE INVENTION

The invention relates to apparatus for melting snow and ice from driveways, paths and roads.

BACKGROUND OF THE INVENTION

Prior known snow melting devices have not been sufficiently convenient to use for melting snow in small areas, such as paths and driveways. The patent to Mouat, U.S. Pat. No. 3,964,183, describes a method of melting a frozen coating on a roadway or runway using an intense beam of visible light. After the coating is freed from the surface, it is broken up and removed. Electric power is provided by a truck mounted motor and generator. Miller, U.S. Pat. No. 3,471,581, also describes apparatus having a truck-mounted engine and generator. The heating element carried in the forward end of the apparatus includes banks of recessed lamps.

The ice melter of Giguere, U.S. Pat. No. 3,189,021, uses hot gases generated by exhaust of a motor to melt snow. A flexible hose is connected from the exhaust to a cover which focuses the heat in an area to be melted. The device is particularly used for melting snow close to the driving wheels of the vehicle stuck in snow. Marcoux, et al., U.S. Pat. No. 3,559,337, describes an apparatus for electroculture for use in farming. An electric arc is formed by rotating pairs of electrodes mounted on a vehicle and is used for destruction of vegetation. None of these patents contemplate providing a self-contained apparatus, as described below.

SUMMARY OF THE INVENTION

Snow melting apparatus includes a hand-propelled wheeled frame on which is mounted a motor and generator, a heater spaced from the ground to be cleared of snow and a reflector for directing heat downward toward the snow. The snow melter is propelled by a user walking behind the apparatus. The heater includes heating elements which may be covered by plates for reflecting heat downward as the snow melter is moved across snow-covered ground, clearing the area passed over by the apparatus. The heater may include two or more heating units. A forward heating unit may be hinged to a rearward heating unit to allow the forward unit to be raised for ease of moving the apparatus and for storage.

It is an object of the invention to provide a hand-propelled apparatus for melting snow and ice.

DETAILED DESCRIPTION OF THE INVENTION

The apparatus is a compact, easy to use snow melting apparatus for rapidly clearing driveways and paths of snow or ice. The device is not much bigger than a lawn mower, has its own motor and generator and may be pushed over a driveway or path to clear snow or ice rapidly.

The apparatus described has a gasoline powered motor and generator mounted thereon. An electrically powered device is equally within the scope of the invention.

Figure 1:
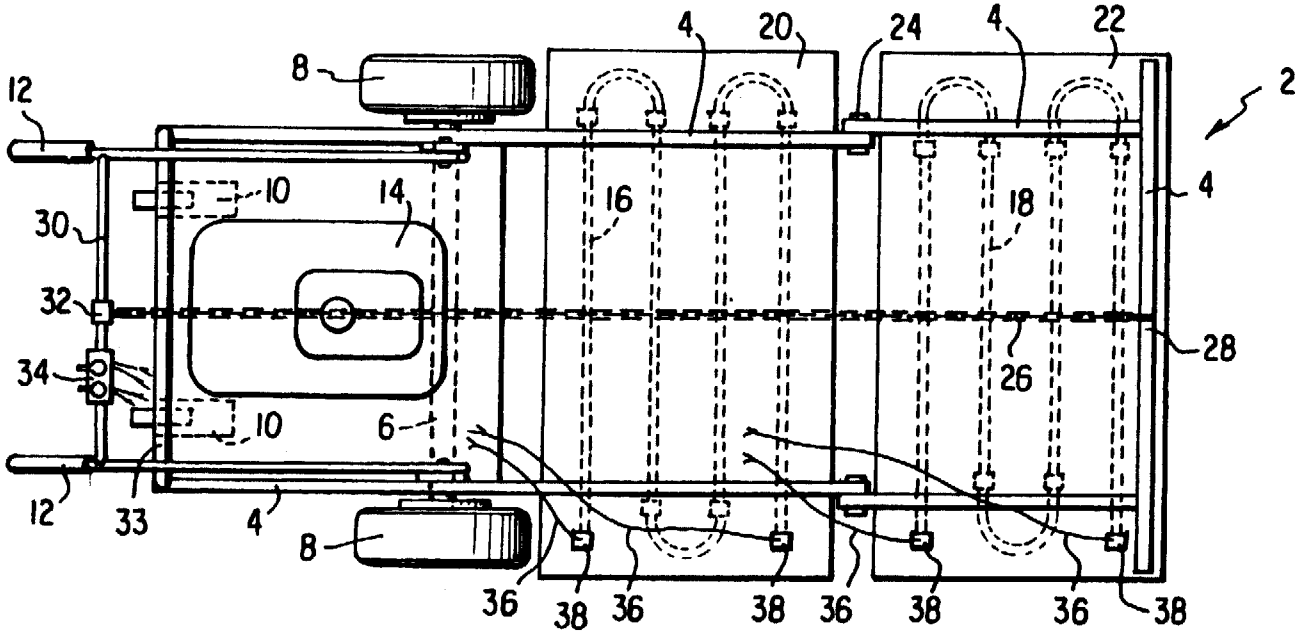
FIG. 1 is a top plan view of apparatus of the invention.
Figure 2:
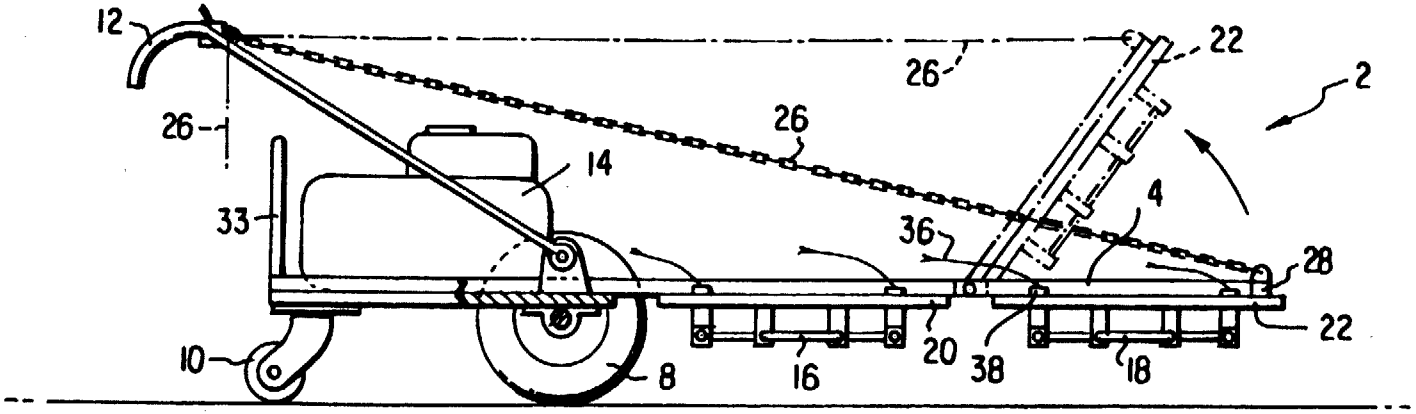
FIG. 2 is a side view, partly in cross-section of the apparatus of FIG. 1, showing the raised position in phantom.

With reference to the Figures, in which like numerals represent like parts, FIGS. 1 and 2 illustrate apparatus 2 for melting snow. Snow melting apparatus 2 has a frame 4 which supports axle 6 for load-bearing wheels 8. Rear wheels 10, which may be castors, are attached to frame 4. Apparatus 2 is pushed along a path or over an area to be cleared of snow using handles 12 which are connected to the axle structure for steering the apparatus.

Gasoline motor and generator 14 is mounted on frame 4 and axle 6 may be a driven axle. Frame 4 supports heating element 16 and heating element 18. Heating elements 16 and 18 may be electric coil heating elements or other suitable heaters known in the art. Rearward heating element 16 is attached to rearward plate 20 which is secured to frame 4. Forward heating element 18 is attached to forward plate 22 which is secured to frame 4. Frame 4 is hinged between plates 20 and 22 so that plate 20 is hingedly connected to plate 20 by hinged connection 24 of frame 4. Plates 20 and 22 reflect heat downward toward ground to be cleared of snow and/or ice. Any appropriate configuration of plates 20 and 22 which reflects heat toward the ground may be used.

Chain 26 is secured to forward end 28 of frame 4 and to handle bar 30. Chain 26 may be pulled or wound by a device 32 attached to handle bar 30 to raise forward end 28 of frame 4, together with heating element 18, by angular rotation about hinged connection 24. This is illustrated by the phantom lines in FIG. 2. Raising the forward end of the apparatus is convenient when moving the apparatus to and from areas to be cleared of snow and for storage. The forward unit may also be raised if the apparatus is operated using the rearward heating unit only.

If required, the snow melting apparatus described may have only one heating unit, such as the rearward unit described above. Alternatively, a longer device, having a greater number of heating units, may be used.

Heating elements 16 and 18 are turned on and off using controls 34 on handle bar 30. Leads 36 attached to connectors 38 secured to plates 20 and 22 connect controls 34 to heaters 16 and 18. Guard 33 is secured to frame 4 for safety in using the apparatus.

In use, motor and generator 14 is started, controls 34 are turned on and heaters 16 and 18 warm up. The apparatus is pushed over the area to be cleared of snow and ice. After the task has been accomplished, the forward end of the apparatus may be raised and the apparatus returned to storage.

While the invention has been described with respect to certain embodiments thereof, variations and modifications may be made without departing from the spirit and scope of the invention.

What is claimed is:

1. Apparatus for melting snow and ice comprising:

a hand operated wheeled frame;

means for moving said frame over ground to be cleared of snow and ice;

means for heating attached to said frame and spaced from the ground sufficiently to melt snow and ice thereon;

means adjacent said heating means for reflecting heat toward the ground comprising first plate means attached to a forward part of said frame for supporting first heating means and second plate means attached to a rearward part of said frame for supporting second heating means;

wherein said forward part of said frame and said rearward part of said frame are joined by a hinged connection.

2. Apparatus according to claim 1 further comprising means for angularly rotating said forward part of said frame.

3. Apparatus according to claim 2 wherein said means for rotating comprises a chain extending between said forward part of said frame and a rearward part of said apparatus and means for adjusting the length of said chain therebetween.

* * * * *